US005426786A

United States Patent [19]

Calvin

[11] Patent Number: 5,426,786

[45] Date of Patent: Jun. 27, 1995

[54] PROTECTIVE HIP/SPINE PAD FOR STREET SPORT/EXERCISE ACTIVITY

[75] Inventor: Timothy D. Calvin, Melbourne, Fla.

[73] Assignee: Calvin Corporation, Palm Bay, Fla.

[21] Appl. No.: 12,563

[22] Filed: Feb. 2, 1993

[51] Int. Cl.[6] ..... A41D 13/00

[52] U.S. Cl. ..... 2/2; 2/267

[58] Field of Search ..... 2/23, 24, 227, 228, 2/214, 215, 267, 238, 2; D6/596, 597; 5/653, DIG. 1

[56] References Cited

U.S. PATENT DOCUMENTS

| | | | |
|---|---|---|---|
| 2,637,032 | 5/1953 | Pinsuti | 2/23 |
| 3,382,511 | 5/1968 | Brooks | D6/596 |
| 4,128,902 | 12/1978 | Siebert | 2/2 |
| 4,737,994 | 4/1988 | Galton | 2/2 |
| 4,894,867 | 1/1990 | Ceravolo et al. | 2/23 |
| 5,103,505 | 4/1992 | Llorens | 2/267 |
| 5,134,726 | 8/1992 | Ross | 2/2 |

FOREIGN PATENT DOCUMENTS

| | | | |
|---|---|---|---|
| 20107 | 11/1891 | United Kingdom | 2/267 |

*Primary Examiner*—Clifford D. Crowder
*Assistant Examiner*—Gloria Hale
*Attorney, Agent, or Firm*—Charles Wands

[57] ABSTRACT

An energy-absorbing pad-type device is configured and sized to be inserted within the pants of the wearer adjacent to the wearer's hip and buttocks area, so as to provide an energy-absorbing barrier between the lower extremity of the spine, pelvic girdle, and bottom of the hip bone region, and thereby protect the wearer's hip and buttocks area against injury in the event the person wearing the pad should fall on a hard surface such as a sidewalk or street surface. The protective device comprises a generally flat pad made of elastically deformable multi closed cell polymer material. The pad has a top edge portion, a pair of tapered first and second side edge portions that extend from the top edge portion, and a bottom portion to which the first and second side edge portions extend. The bottom edge portion has first and second generally convexly curved edge portions adjacent to the first and second side edge portions, respectively, and is sized to extend in proximity of the lower hip area of the wearer when the pad device is placed within the wearer's pants adjacent to the buttocks. Pad material which is contiguous with the first and second generally convexly curved edge portions extends along and protects the pelvic girdle, bottom of the wearer's hip bone. A generally central portion of the bottom of the pad, has a slight concave shape that is shaped to generally conform with a crotch portion of the wearer's pants to stabilize the pad within the seat of the pants of the wearer and provide an effective energy-absorbing barrier at the bottom of the spine.

8 Claims, 2 Drawing Sheets

PROTECTIVE HIP/SPINE PAD FOR STREET SPORT/EXERCISE ACTIVITY

FIELD OF THE INVENTION

The present invention relates in general to energy-absorbing protective devices worn by a participant in 'street'-type sport and exercise activities, such as skateboarding and rollerskating, and is particularly directed to a protective pad which is configured and sized to fit within the pants of the wearer adjacent to the wearer's hip and buttocks area, so as to provide an energy-absorbing barrier between the lower extremity of the spine, pelvic girdle and bottom of the hip bone of the wearer and thereby protect the wearer's hip and buttocks area against injury in the event the person wearing the pad should fall on a hard surface, such as a sidewalk or street surface.

BACKGROUND OF THE INVENTION

Persons who participate in sporting and exercise activities such as skateboarding and roller-skating, that customarily take place on a hard and unforgiving surface such as the concrete or asphalt of a sidewalk, parking lot or street, typically equip themselves with a variety of protective equipments, such as helmets, and elbow, wrist and knee pads, as safety measures against collisions and falls. Unfortunately, a major area of the body which remains unprotected in the event of a fall (a not-infrequent occurrence, particularly in the case of a novice) is the pelvic girdle, bottom of the hip region and the lower (tailbone) extremity of the spine, especially when the participant goes 'straight down and lands in a generally sitting or prone position.

SUMMARY OF THE INVENTION

In accordance with the present invention, this problem is successfully addressed by a shock or energy-absorbing protective pad-type device which is configured and sized to be inserted within the seat portion of the pants of the wearer adjacent to the wearer's hip and buttocks area, so as to provide a shock or energy-absorbing barrier adjacent the lower extremity of the spine, pelvic girdle and bottom of the hip bone of the wearer, and thereby protect the wearer's hip and buttocks area against injury in the event the person wearing the pad should fall on a hard surface such as a sidewalk or street surface.

The protective device according to the present invention comprises a generally flat pad made of elastically deformable material which has an increasing resistance to compression as the extent to which the material is compressed increases, so that it will effectively absorb the substantial shock or energy of impact of the wearer of the pad with a hard surface. A multi closed cell polymer material, such as a compound of styrene-butadiene, cross-linked polyethylene, ethylene vinyl acetate, vinyl nitrile and butyl rubber, is particularly suited for this purpose.

The pad is configured to have a top edge portion, a pair of first and second side edge portions that extend from the top edge portion, and a bottom portion to which the first and second side edge portions extend. The first and second side edge portions of the pad having a first spacing therebetween at the bottom edge portion which is greater than a second spacing therebetween at the top edge portion of the pad, so that the first and second side edge portions of the pad are tapered from the hip area of the wearer to the waist area of the wearer and thereby conform with the wearer's torso and pants.

The bottom edge portion has first and second generally convexly curved edge portions adjacent to the first and second side edge portions, respectively, and is sized to extend in proximity of the lower hip area of the wearer when the pad device is placed within the wearer's pants adjacent to the buttocks. Pad material which is contiguous with the first and second generally convexly curved edge portions extends along and protects the pelvic girdle and the bottom of the wearer's hip bone.

A generally central portion of the bottom edge of the pad, between its first and second convexly curved edge portions, has a slight concave shape that is dimensioned so as to generally conform with a crotch portion of the wearer's pants and provide an effective energy-absorbing barrier at the pelvic girdle and bottom of the spine, while still allowing freedom of movement of the wearer. The slight concave shape of the bottom central edge portion of the inventive pad stabilizes the pad within the wearer's pants, while also placing material of the central lower portion of the pad against the lower extremity of the spine. As a result, in the event of the wearer falling and landing on the hip and buttocks area, material of that portion of the pad that is contiguous with the bottom edge portion will absorb the shock or energy of impact of the wearer's fall and thereby protect the lower extremity of the spine, pelvic girdle and bottom of the hip bone.

DETAILED DESCRIPTION

Figure 1:
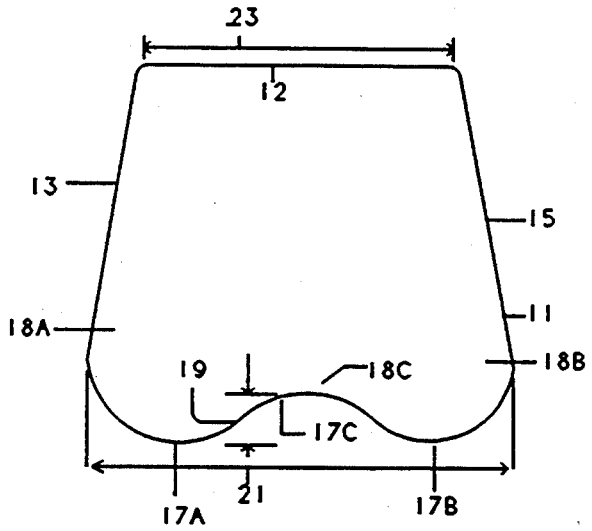
FIGS. 1 and 2 are respective top and side views of a protective pad device in accordance with the present invention.
Figure 2:
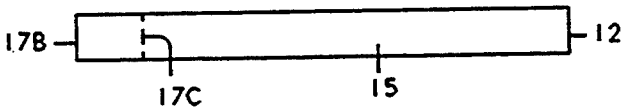
Figure 3:
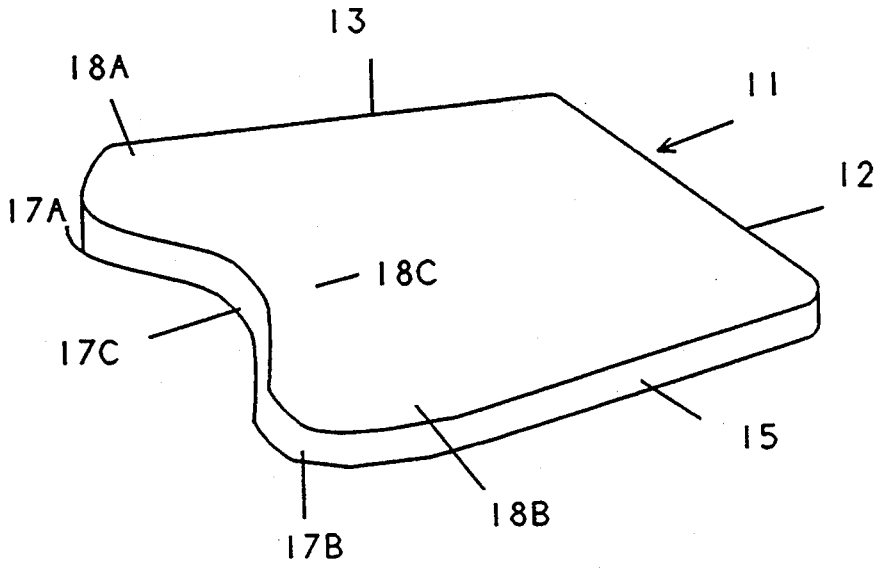
FIG. 3 is a perspective view of a protective pad device in accordance with the present invention.

Referring now to FIGS. 1–3, the protective device according to the present invention is shown as comprising a generally flat pad 11 that is sized and configured to be insertable within the seat portion of the pants of a user, so that the pad may abut against the pelvic girdle, buttocks and lower hip portion of the wearer. The material of pad 11 is an elastically deformable material, which has an increasing resistance to compression as the extent to which the material is compressed increases, so that it will effectively absorb the substantial energy of impact of the wearer of the pad with a hard surface. For this purpose, the material of the pad 11 is preferably a multi closed cell polymer sponge-like material, such as a compound of styrene-butadiene, cross-linked polyethylene, ethylene vinyl acetate, vinyl nitrile and butyl rubber. Pad 11 may have a thickness on the order of five-eighths of an inch, so that it may be accommodated in the seat portion of the user's pants, while still having sufficient thickness to enable the energy-absorbing, elastic deformation property of the closed cell polymer material to provide an effective energy-absorbing barrier in the event of the fall of the wearer.

Pad 11 has a top edge portion 12, a pair of first and second side edge portions 13, 15, respectively, that extend from the top edge portion 11, and a bottom edge portion 17 to which the first and second side edge portions extend. The first and second side edge portions 13, 15 of the pad have a first spacing or separation 21 therebetween at the bottom edge portion 17, which separation is greater than a second spacing 23 therebetween at the top edge portion 12 of the pad, so that the first and second side edge portions of the pad are tapered from the hip area of the wearer to the waist area of the wearer and thereby conform with the wearer's torso and pants.

The bottom edge portion 17 has first and second generally convexly curved edge portions 17A, 17B adjacent to the first and second side edge portions 13, 15, respectively, and is sized to extend in proximity of the lower hip area of the wearer when the pad device is placed within the seat portion of the wearer's pants adjacent to the buttocks. Portions 18A, 18B of pad material, which are contiguous with the first and second generally convexly curved edge portions 17A, 17B, extend along and protect the pelvic girdle and bottom of the wearer's hip bone.

A generally central edge portion 17C of the bottom edge of the pad, between first and second convexly curved edge portions 17A, 17B, has a slight concave shape that is dimensioned so as to generally conform with a crotch portion of the wearer's pants and provide an effective energy-absorbing barrier at the pelvic girdle region/bottom of the spine, while still allowing freedom of movement of the wearer. The concave surface of central edge portion 17C may be set back or indented, as shown at 19, by approximately one inch from convex surface edges 17A, 17B. This slightly indented concave shape of the bottom central edge portion 17C of the pad stabilizes the pad within the wearer's pants, while also placing material of the central lower portion 18C of the pad against the lower extremity of the spine. As a result, in the event of the wearer falling and landing on the hip and buttocks area, material of that portion of the pad that is contiguous with the bottom edge portion will absorb the energy of impact of the wearer's fall and thereby protect the lower extremity of the spine, pelvic girdle and bottom of the hip bone.

As will be appreciated from the foregoing description, the need to protect the bottom of the hip region and especially the pelvic girdle, lower extremity of the spine of a person participating in sporting and exercise activities such as skateboarding and roller-skating, particularly in the event of a fall into a 'straight down sitting position, is successfully addressed in accordance with the energy-absorbing protective pad-type device of the present invention, which is configured and sized to be inserted within the pants of the wearer adjacent to the wearer's hip and buttocks area, so as to provide a shock or energy-absorbing barrier between the lower extremity of the spine and pelvic girdle, bottom of the hip bone region of the body of the wearer and thereby protect the wearer's hip and buttocks area against injury in the event the person wearing the pad should fall on a hard surface such as a sidewalk or street surface.

While I have shown and described an embodiments in accordance with the present invention, it is to be understood that the same is not limited thereto but is susceptible to numerous changes and modifications as known to a person skilled in the art, and I therefore do not wish to be limited to the details shown and described herein but intend to cover all such changes and modifications as are obvious to one of ordinary skill in the art.

What is claimed is:

1. A protective device to be worn within the seat of the pants of a wearer adjacent to the hip and buttocks area, so as to protect the wearer's hip and buttocks area against injury, said protective device comprising a generally flat pad made of multi closed cell elastically deformable material having increasing resistance to compression as the extent to which said material is compressed increases, and being configured to have a top edge portion, a pair of first and second side edge portions that extend from said top edge portion, and a bottom portion to which said first and second side edge portions extend, said bottom edge portion having first and second generally convexly curved edge portions adjacent to said first and second side edge portions, respectively, and being sized to extend in proximity of the lower hip area of the wearer when the pad device is placed within the wearer's pants adjacent to the buttocks, so that said top edge portion of said paid is located adjacent to the waist area of the wearer, and material of said pad, that is contiguous with said first and second generally convexly curved edge portions, extends adjacent to the pelvic girdle, bottom of the hip bone of the wearer, and a concavely curved edge portion extending between said first and second convexly curved edge portions, said concavely curved edge portion being dimensioned so as to be accommodated by a crotch portion of the wearer's pants and such that material of said pad contiguous with said concavely curved edge portion effectively covers the lower extremity of the spine of the wearer, whereby, in the event of the wearer falling and landing on said hip and buttocks area, material of said pad device contiguous with said bottom edge portion absorbs energy of the wearer's fall and thereby provides an energy-absorbing barrier between the lower extremity of the spine, pelvic girdle and bottom of the hip bone of the wearer and an impacting surface on which the wearer falls.

2. A protective device according to claim 1, wherein said multi closed cell elastically deformable material comprises closed cell sponge polymer material.

3. A protective device according to claim 1, wherein said multi closed cell elastically deformable material comprises a polymer material selected from the group consisting of a compound of styrene-butadiene, cross-linked polyethylene, ethylene vinyl acetate, vinyl nitrile and butyl rubber.

4. A protective device according to claim 1, wherein said first and second side edge portions of said pad having a first spacing therebetween at said bottom edge portion of said pad that is greater than a second spacing therebetween at said top edge portion of said pad, such that said first and second side edge portions of said pad taper from the hip area of the wearer to the waist area of the wearer.

5. An energy-absorbing protective pad-type device comprising a generally flat pad that is sized and configured to be insertable within the seat portion of the pants of a user so that the pad may abut against the buttocks and lower hip portion of the wearer, said pad being formed of a material that is elastically deformable multi closed cell sponge-like material, having an increasing resistance to compression as the extent to which the material is compressed increases, so that it will effectively absorb the substantial energy of impact of the wearer of the pad with a hard surface, and a thickness that allows the pad to be accommodated in the seat portion of the user's pants, while still having sufficient thickness to enable the energy-absorbing, elastic deformation property of the closed cell polymer material to provide an effective energy-absorbing barrier in the event of the fall of the wearer, said pad having a top edge portion, a pair of first and second side edge portions that extend from the top edge portion, and a bottom portion to which the first and second side edge portions extend, said first and second side edge portions of the pad have a first spacing therebetween at the bottom edge portion, which is greater than a second spacing therebetween at the top edge portion of the pad, so that the first and second side edge portions of the pad are tapered from the hip area of the wearer to said top edge portion adjacent to the waist area of the wearer and thereby conform with the wearer's torso and pants, the bottom edge portion having first and second generally convexly curved edge portions adjacent to the first and second side edge portions, respectively, and being sized to extend in proximity of the lower hip area of the wearer when the pad device is placed within the seat portion of the wearer's pants adjacent to the buttocks, and a third concave portion, which is contiguous with the first and second generally convexly curved edge portions at a generally central portion of the bottom edge of the pad and is located between the first and second convexly curved edge portions, said third, concave portion being dimensioned so as to generally conform with a crotch portion of the wearer's pants pad, thereby stabilizing the pad within the wearer's pants, while also placing material of the central lower portion of the pad against the lower extremity of the spine.

6. A method of protecting the lower extremity of the spine, pelvic girdle and bottom of the hip bone of a person participating in sporting and exercise activities, such as skateboarding and roller-skating, in the event the person should fall on a hard surface such as a sidewalk or street surface comprising the steps of:

(a) providing an energy-absorbing protective pad-type device in the form of a generally flat pad that is sized and configured to be insertable within the seat portion of the pants of a user so that the pad may abut against the buttocks and lower hip portion of the wearer, said pad being formed of a material that is elastically deformable multi closed cell sponge-like material, having an increasing resistance to compression as the extent to which the material is compressed increases, so that it will effectively absorb the substantial energy of impact of the wearer of the pad with a hard surface, and a thickness that allows the pad to be accommodated in the seat portion of the user's pants, while still having sufficient thickness to enable the energy-absorbing, elastic deformation property of the closed cell polymer material to provide an effective energy-absorbing barrier in the event of the fall of the wearer, said pad having a top edge portion, a pair of first and second side edge portions that extend from the top edge portion, and a bottom portion to which the first and second side edge portions extend, said first and second side edge portions of the pad have a first spacing therebetween at the bottom edge portion, which is greater than a second spacing therebetween at the top edge portion of the pad, so that the first and second side edge portions of the pad are tapered from the hip area of the wearer to said top edge portion adjacent to the waist area of the wearer and thereby conform with the wearer's torso and pants, the bottom edge portion having first and second generally convexly curved edge portions adjacent to the first and second side edge portions, respectively, and being sized to extend in proximity of the lower hip area of the wearer when the pad device is placed within the seat portion of the wearer's pants adjacent to the buttocks, and a third concave portion, which is contiguous with the first and second generally convexly curved edge portions at a generally central portion of the bottom edge of the pad and is located between the first and second convexly curved edge portions, said third, concave portion being dimensioned so as to generally conform with a crotch portion of the wearer's pants pad, thereby stabilizing the pad within the wearer's pants, while also placing material of the central lower portion of the pad against the lower extremity of the spine; and (b) inserting the pad provided in step (a) in the seat portion of wearer's pants such that said top edge portion is adjacent to the waist area of the wearer and said third, concave portion is stabilized by the crotch portion of the wearer's pants and so that said pad abut against the buttocks and lower hip portion of the wearer.

7. A method according to claim 6, wherein said pad is made of a multi closed cell elastically deformable sponge polymer material selected from the group consisting of a compound of styrene-butadiene, cross-linked polyethylene, ethylene vinyl acetate, vinyl nitrile and butyl rubber.

8. An energy-absorbing protective pad-type device according to claim 5, wherein said multi closed cell elastically deformable material comprises a polymer material selected from the group consisting of a compound of styrene-butadiene, cross-linked polyethylene, ethylene vinyl acetate, vinyl nitrile and butyl rubber.

* * * * *